US010295187B2

(12) United States Patent
Williams et al.

(10) Patent No.: US 10,295,187 B2
(45) **Date of Patent: *May 21, 2019**

(54) FUEL NOZZLE HAVING AERODYNAMICALLY SHAPED HELICAL TURNING VANES

(71) Applicant: Rolls-Royce plc, London (GB)

(72) Inventors: Brandon P. Williams, Urbandale, IA (US); Kevin E. Thompson, West Des Moines, IA (US); Robert R. Fogarty, West Des Moines, IA (US)

(73) Assignee: Rolls-Royce plc (GB)

( * ) Notice: Subject to any disclaimer, the term of this patent is extended or adjusted under 35 U.S.C. 154(b) by 260 days.

This patent is subject to a terminal disclaimer.

(21) Appl. No.: 15/332,096

(22) Filed: Oct. 24, 2016

(65) Prior Publication Data

US 2017/0038072 A1 Feb. 9, 2017

Related U.S. Application Data

(62) Division of application No. 12/378,654, filed on Feb. 18, 2009, now Pat. No. 9,513,009.

(51) Int. Cl.

| | |
|---|---|
| ***F23R 3/14*** | (2006.01) |
| ***F23D 11/10*** | (2006.01) |
| ***F23R 3/28*** | (2006.01) |

(52) U.S. Cl.

CPC ..... *F23R 3/14* (2013.01); *F23D 11/107* (2013.01); *F23R 3/28* (2013.01)

(58) Field of Classification Search

CPC ..... F23R 3/14; F23R 3/28; F23D 11/107
USPC ..... 60/737, 740, 742, 748
See application file for complete search history.

(56) References Cited

U.S. PATENT DOCUMENTS

| | | | |
|---|---|---|---|
| 5,511,375 | A | 4/1996 | Joshi |
| 5,865,024 | A | 2/1999 | Kress et al. |
| 6,141,967 | A | 11/2000 | Angel et al. |
| 6,272,840 | B1 | 8/2001 | Crocker et al. |
| 6,460,344 | B1 | 10/2002 | Steinthorsson et al. |
| 6,560,964 | B2 | 5/2003 | Steinhorsson et al. |
| 6,755,024 | B1 | 6/2004 | Mao et al. |
| 6,883,332 | B2 | 4/2005 | Steinthorsson et al. |
| 2003/0196440 | A1 | 10/2003 | Steinthorsson et al. |
| 2005/0268618 | A1 | 12/2005 | Johnson et al. |
| 2007/0289306 | A1 | 12/2007 | Suria et al. |
| 2008/0078183 | A1 | 4/2008 | Ziminsky et al. |
| 2008/0083229 | A1 | 4/2008 | Haynes et al. |

(Continued)

FOREIGN PATENT DOCUMENTS

| | | | |
|---|---|---|---|
| DE | 102004059882 | A1 | 6/2006 |
| GB | 2481075 | A | 12/2011 |
| WO | 2009069426 | A1 | 6/2009 |

OTHER PUBLICATIONS

UK Intellectual Property Search Report dated May 21, 2010.

(Continued)

*Primary Examiner* — Arun Goyal

(74) *Attorney, Agent, or Firm* — Barnes & Thornburg LLP

(57) ABSTRACT

A fuel nozzle for a gas turbine engine is disclosed which includes a nozzle body having a longitudinal axis, an elongated annular air passage defined within the nozzle body, and a plurality of circumferentially spaced apart axially extending swirl vanes disposed within the annular air passage, wherein each swirl vane has multiple joined leads and a variable thickness along the axial extent thereof.

10 Claims, 4 Drawing Sheets

(56) References Cited

U.S. PATENT DOCUMENTS

| | | | |
|---|---|---|---|
| 2008/0148736 | A1 | 6/2008 | Ishizaka et al. |
| 2008/0289341 | A1 | 11/2008 | Ishizaka et al. |

OTHER PUBLICATIONS

UK Intellectual Property Examination Report dated Oct. 1, 2012.
French Preliminary Search report National Registration No. FR10000363, dated Apr. 21, 2015 (3 pages).
Opinion Written on the Patentability of the Invention, National Registration No. FR10000363, dated Jan. 29, 2010 (5 pages).
Search Report under Section 17, Application No. GB1309512.0, dated Aug. 9, 2013 (1 page).
Combined Search and Examination report under Section 17 and 18(3), Application No. GB1309512.0, dated Aug. 12, 2013 (2 pages).
English Machine Translation of Opinion Written on the Patentability of the Invention, National Registration No. FR100000363, dated Jan. 29, 2010 (5 pages).

FUEL NOZZLE HAVING AERODYNAMICALLY SHAPED HELICAL TURNING VANES

BACKGROUND OF THE INVENTION

1. Field of the Invention

The subject invention is directed to fuel nozzles for gas turbine engines, and more particularly, to an air swirler for fuel nozzles having aerodynamically shaped helical turning vanes for efficiently turning the air flow passing through the swirler while minimizing the risk of separation.

2. Description of Related Art

In a fuel nozzle for a gas turbine engine, compressor discharge air is used to atomize liquid fuel. More particularly, the air provides a mechanism to breakup a fuel sheet into a finely dispersed spray that is introduced into the combustion chamber of an engine. Quite often the air is directed through a duct that serves to turn or impart swirl to the air. This swirling air flow acts to stabilize the combustion reaction.

There are many ways to develop swirl in a fuel nozzle. Historically, helical vanes were used because of their ability to effectively turn the air flow. These vanes generated acceptable air flow characteristics for many engine applications. However, when a higher swirl factor was desired for certain engine application, there was a tendency for the air flow to separate from the helical vanes. This was generally associated with a reduction in the effectiveness of the geometric flow area of the nozzle.

To mitigate separation, vanes were designed with multiple joined leads that could aid in turning the air flow. These vanes were typically associated with a higher effectiveness of the geometric flow area of the nozzle. Such improvements resulted in a more effective use of the air velocity for atomization.

Air swirlers have also been developed that employ aerodynamic turning vanes, as described in U.S. Pat. No. 6,460,344 to Steinthorsson et al., the disclosure of which is incorporated herein by reference in its entirety. These airfoil shaped turning vanes are effective to impart swirl to the atomizing air flow. However, they provide a substantially uniform velocity profile at the nozzle.

It would be beneficial to provide an air swirler for a fuel nozzle having turning vanes that incorporate the beneficial aspects of multiple joined helical leads and an aerodynamic shape. In so doing, air flow through the swirler could be efficiently turned while the risk of separation would be minimized.

SUMMARY OF THE INVENTION

The subject invention is directed to a new and useful fuel nozzle for a gas turbine engine. The novel fuel nozzle includes a nozzle body having a longitudinal axis, an elongated annular air passage defined within the nozzle body, and a plurality of circumferentially spaced apart axially extending swirl vanes disposed within the annular air passage, each swirl vane having multiple joined leads and a variable thickness along the axial extent thereof.

Each swirl vane includes an upstream vane section having a leading edge surface and a downstream vane section having a trailing edge surface. The leading edge surface of the upstream vane section of each vane is disposed at an angle relative to the longitudinal axis of the nozzle body. The angle of the leading edge surface of each vane defines an initial pitch along the axial extent of the upstream vane section. The pitch of the downstream vane section of each vane varies from the pitch of the upstream vane section of each vane, forming a vane having multiple joined leads.

In one embodiment of the subject invention, the pitch of the downstream vane section varies continuously along substantially the entire axial extent of the downstream vane section. In another embodiment of the subject invention, the pitch of the downstream vane section remains constant for a certain axial vane segment or for substantially the entire axial length of the downstream vane section. In yet another embodiment of the subject invention, two or more contiguous axial vane segments of the downstream vane section have different but constant pitches, such that the downstream vane section has multiple joined leads along the axial extent thereof. In each instance, each vane includes a transitional vane section that smoothly blends the upstream vane section into the downstream vane section.

Each vane has a maximum normal thickness associated with the transitional vane section. In one embodiment of the subject invention, the normal vane thickness changes or otherwise decreases from the transitional vane section to the trailing edge surface of the vane. Preferably, the normal vane thickness also changes or otherwise decreases from the transitional vane section to the leading edge surface of the vane. However, it is envisioned that the lead-in vane section that extends from the leading edge to the transitional vane section could have a constant vane thickness. It is also envisioned that any axial vane segment along the axial extent of the vane could have a constant vane thickness. In any case, the resulting airfoil shaped helical vanes of the subject invention function to effectively impart a high degree of swirl while minimizing the risk of separation.

The subject invention is also directed to a new and useful air swirler for a fuel nozzle. The novel air swirler includes a central hub defining a longitudinal axis, and a plurality of circumferentially spaced apart axially extending aerodynamically shaped swirl vanes extending radially outwardly from the hub, wherein each swirl vane has multiple joined leads along the axial extent thereof.

These and other features of the fuel nozzle and air swirler of the subject invention will become more readily apparent to hose having ordinary skill in the art form the following detailed description of the invention taken in conjunction with the several drawings figures.

BRIEF DESCRIPTION OF THE DRAWINGS

So that those skilled in the art to which the subject invention appertains will readily understand how to make and use the airfoil shaped helical turning vanes of the subject invention without undue experimentation, preferred embodiments thereof will be described in detail herein below with reference to certain figures, wherein.

DETAILED DESCRIPTION OF PREFERRED EMBODIMENTS

Figure 1:
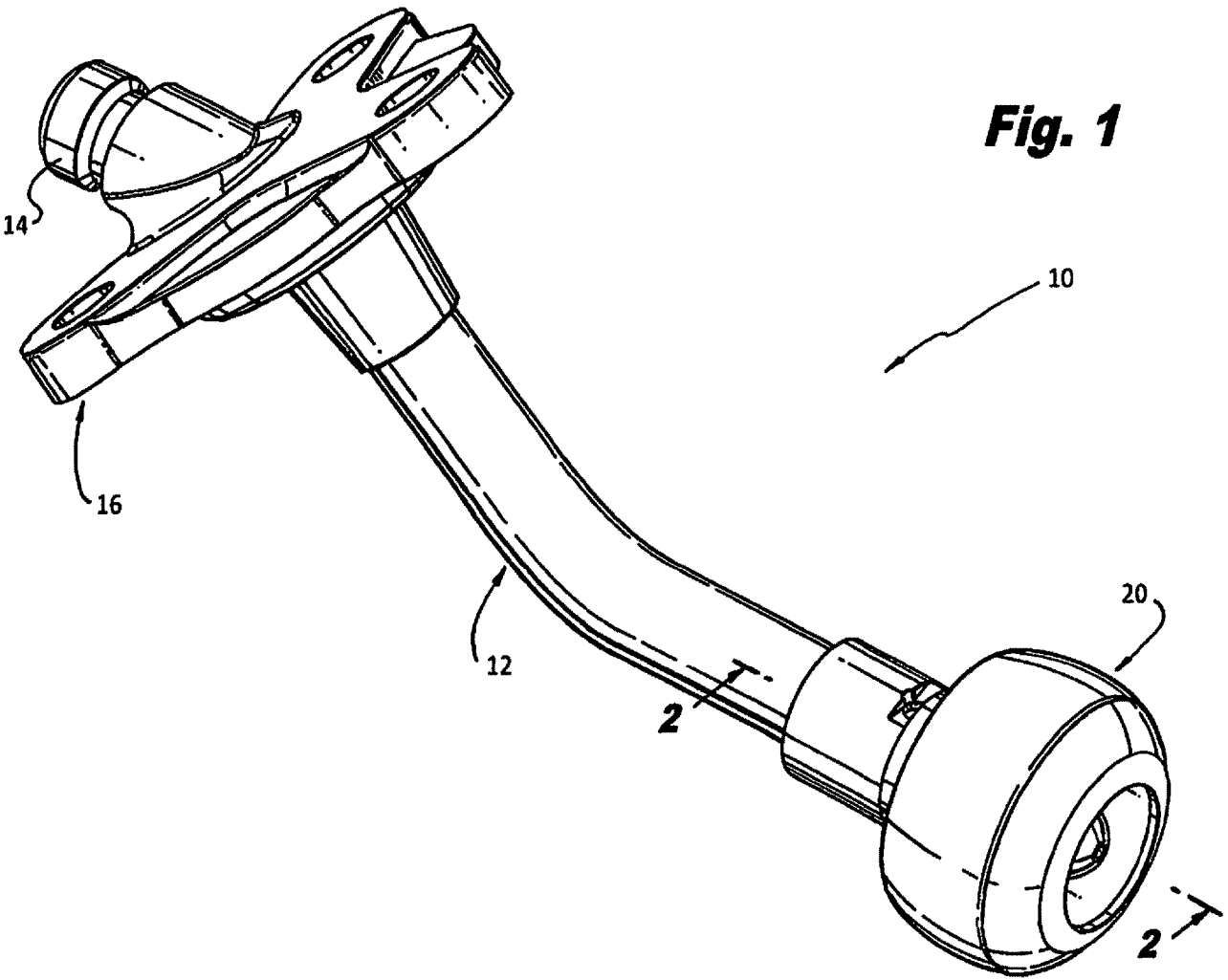
FIG. 1 is a perspective view of a fuel injector which includes a nozzle assembly, having an air swirler with airfoil shaped helical turning vanes constructed in accordance with a preferred embodiment of the subject invention.

Referring now to the drawings, wherein like reference numerals identify or otherwise refer to similar structural features or elements of the various embodiments of the subject invention, there is illustrated in FIG. 1 a fuel injector for a gas turbine engine. Fuel injector 10 includes an elongated feed arm 12 having an inlet portion 14 for receiving fuel, a mounting flange 16 for securing the fuel injector 10 to the casing of a gas turbine engine, and a nozzle assembly 20 at the lower end of the feed arm 12 for issuing atomized fuel into the combustion chamber of a gas turbine engine.

Figure 2:
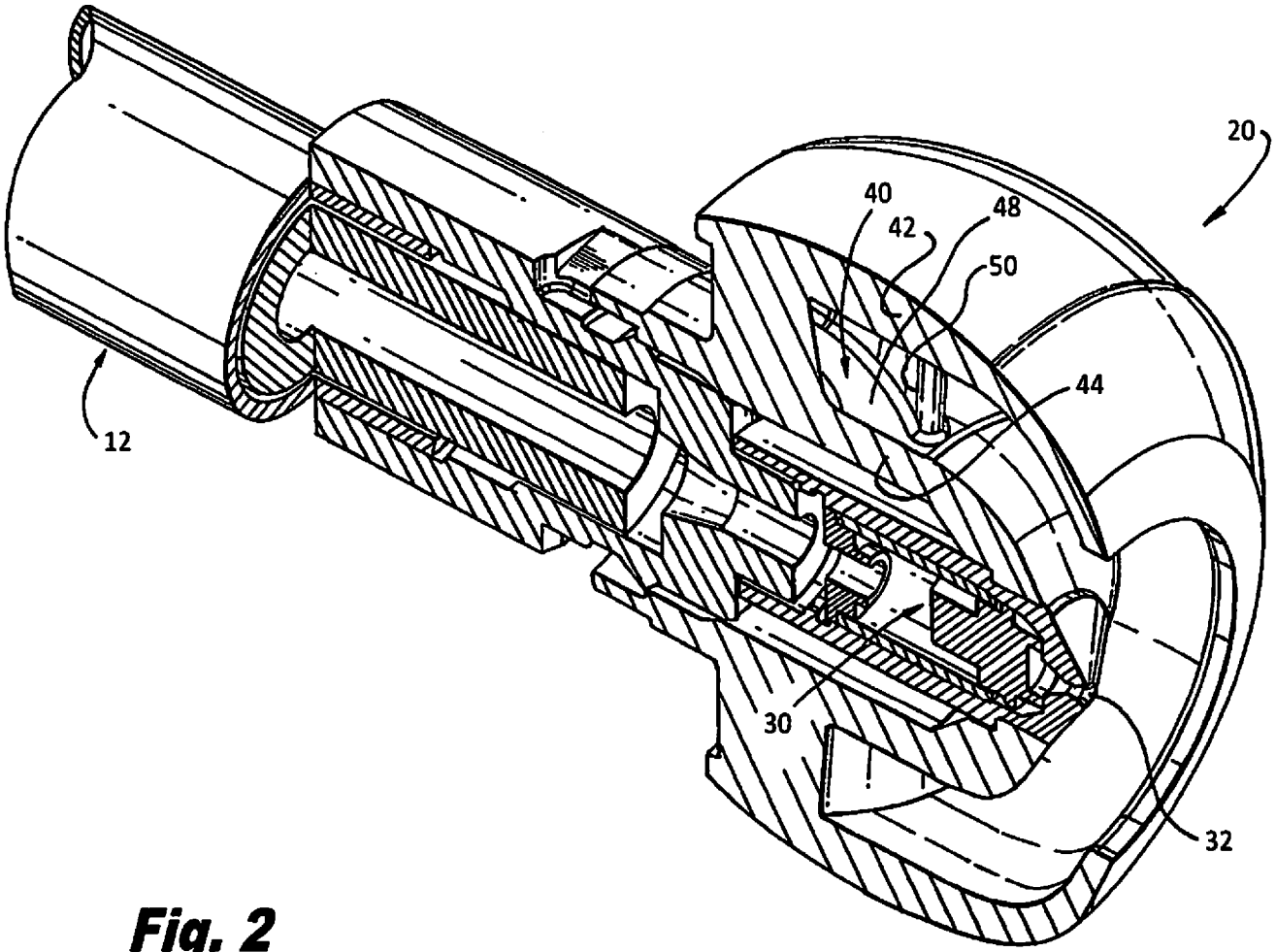
FIG. 2 is an enlarged perspective view of the nozzle assembly, in cross-section, taken along line 2-2 of FIG. 1, illustrating the outer air swirler and inner fuel circuit of the nozzle assembly.

Referring to FIG. 2, the nozzle assembly 20 of fuel injector 10 includes, among other things, an on-axis fuel circuit 30 and an outer air swirler 40 located radially outward of the fuel circuit 30. The axial fuel circuit 30 issues fuel from an exit orifice 32. The air swirler 40 is bounded by an outer air cap 42 and an inner hub 44. Air swirler 40 includes a plurality of circumferentially disposed, equidistantly spaced apart turning vanes 50 forming a plurality of air flow channels 48. The turning vanes 50 are adapted and configured to impart swirl to the airflow, which is directed toward fuel issuing from exit orifice 32. The swirling air impacting the fuel acts to stabilize the combustion reaction and enhance fuel atomization. The number of spaced apart turning vanes 50 in the air swirler 40 can vary depending upon the nozzle and/or engine application. It is envisioned that air swirler 40 can include between three and fifteen turning vanes, but may have more depending upon the application.

Figure 3:
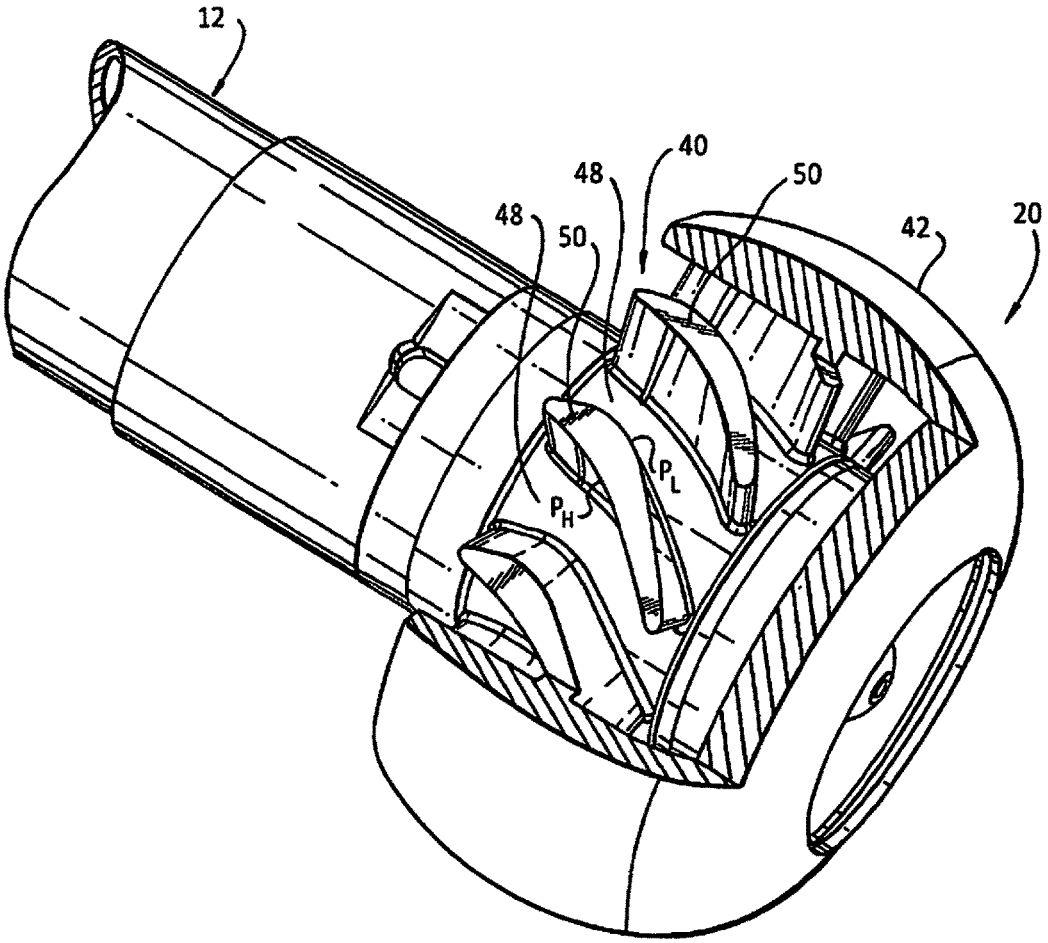
FIG. 3 is an enlarged perspective view of the nozzle assembly shown in FIG. 2, with a section of the outer air cap cut away to show the circumferentially spaced apart airfoil shaped helical turning vanes of the air swirler.

As best seen in FIG. 3, each turning vane 50 in air swirler 40 has an aerodynamic or airfoil shaped cross-sectional profile. That is, the thickness or width of each turning vane 50 changes over the axial length of the vane. Consequently, each turning vane 50 has a suction side or low pressure side $P_L$ and an opposed high pressure side $P_H$. The relative pressure differential on the opposed vane surfaces functions to advantageously keep the swirling airflow across the swirler attached to the vane walls. As a result, air flows efficiently through the air swirler 40 without separating from the vanes.

Figure 4:
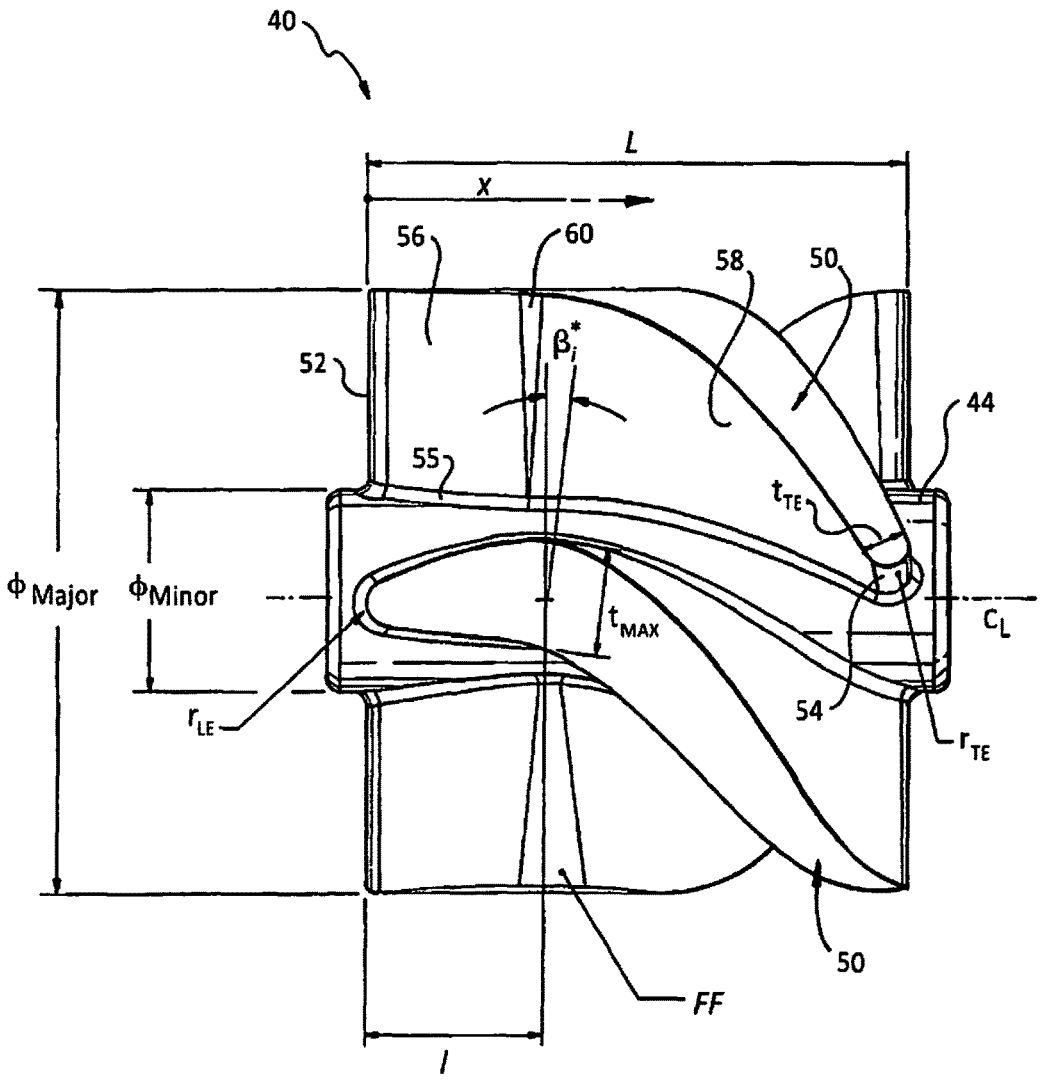
FIG. 4 is a side elevational view of an air swirler constructed in accordance with a preferred embodiment of the subject invention, which includes four airfoil shaped helical turning vanes.

Referring now to FIG. 4, there is illustrated an exemplary air swirler 40 constructed in accordance with the subject invention. This exemplary air swirler has four airfoil shaped turning vanes 50. Each turning vane 50 in air swirler 40 includes three axially extending vane sections ranging from the leading edge 52 of the vane to the trailing edge 54 of the vane. These three vane sections include an upstream vane section 56 that typically has little or no helical pitch associated therewith, a downstream vane section 58 that has a varying helical pitch associated therewith and a transitional vane section 60 located between the upstream and downstream vane sections 56 and 58 that serves to smoothly blend the upstream and downstream vane sections together to form a turning vane having multiple joined leads.

With regard to the varying pitch of the downstream vane section 58, in one embodiment of the subject invention, the pitch varies continuously along substantially the entire axial extent of the downstream vane section 58. In another embodiment of the subject invention, the pitch of the downstream vane section 58 differs from the pitch of the upstream vane section 56 and it is held constant along substantially the entire axial extent of the downstream vane section 58. In yet another embodiment of the subject invention, two or more contiguous axial segments of the downstream vane section 58 have different but constant pitches, such that the downstream vane section 58 has multiple joined leads along the axial extent thereof.

The transitional vane section 60 is defined by a Fillet Factor FF, which is a dimensionless value (e.g., 1.2) related to vane thickness and selected to blend the edges of vane sections 56 and 58 together as smoothly as possible. The leading edge 52 of each vane 50 is preferably radiused (e.g., 0.012 in.) and may be oriented at an angle with respect to the longitudinal axis of the swirler 40. The angle of the leading edge 52 of each vane 50 (i.e., the inlet vane angle) essentially defines the pitch of the upstream vane section 56. Preferably, the angle of the leading edge 52 is oriented to accommodate any directional bias of the air flow into the swirler 40. For example, if the air flowing into the air swirler 40 has a 5° bias, the angle of the leading edge 52 of each vane 50 would be set at 5°, and thus the upstream vane section 56 would have a 5° lead associated therewith. Typically, the angle at the leading edge of the vane is 0° and in such cases the upstream vane section 56 has no helical pitch associated therewith. In an embodiment of the subject invention, the base 55 of each vane 50 at the inner hub 44 is radiused (e.g., 0.1 in.).

As described above, each turning vane 50 has a downstream helically pitched vane section 58. It is envisioned that the lead direction of the helically pitched vane section can be left-handed or right-handed depending upon the overall nozzle design. For example, the pitch direction of the vanes 50 can be the same as or opposite to the pitch direction of an inner air swirler, another outer air swirler or a fuel swirler associated with the on-axis fuel circuit 30 shown in FIG. 2.

As described above, in one embodiment of the subject invention, the pitch of the downstream vane section 58 varies continuously along the axial extent of the turning vane 50. In such a case, the lead or helical pitch of each vane 50 in swirler 40 at any given point x along the axial extent of the vane, referred to as the Instantaneous Lead $\rho_x$, is defined by the following equation:

$$\rho_x = \frac{\phi_{mean}\pi}{\tan(\beta_x^*)}$$

where $Ø_{mean}$ is the mean or mid-span diameter of the vane (e.g., 0.30 in.) and is defined with respect to the major and minor diameters of the swirler by the equation:

$$\phi_{mean} = \frac{\phi_{major} + \phi_{minor}}{2}$$

and $\beta^*_x$ is the Instantaneous Vane Angle defined by the equation:

$$\beta^*_x = \beta^*_{TE} - (\beta^*_{TE} - \beta^*_i)(1-\Delta)^{LF}$$

where: $\beta^*_{TE}$ is the Trailing Edge Vane Angle at the Mid-Span (e.g., 45°); $\beta^*_i$ is the Leading Edge to Turning Blend Angle at Mid-Span (e.g., 10°); $\Delta$ is the Vane Length Ratio, which is a dimensionless quantity defined below; and LF is the Aerodynamic Loading Factor.

The Vane Length Ratio Δ, which is also used below to define the Instantaneous Vane Thickness $t_x$ at any given point along the axial extent of the vane, is defined by the following equation:

$$\Delta = \frac{L-x}{L-l}$$

where: L is the Total Length of the Vane (e.g., 0.4 in.); x is the Axial Vane Position along the axial extent of the vane; and l is the Aerodynamic Lead-In.

The Aerodynamic Lead-In l, which is the lengthwise extent of the vane from the leading edge of the vane to a point at which the vane helix changes value from the lead-in section, is defined by the following equation:

$$l=\gamma(t_{max}-2r_{LE})$$

Where: γ is the Aerodynamic Lead-In Factor (e.g., 2.3); $t_{max}$ is the Maximum Normal Vane Thickness (e.g., 0.06 in.); and $r_{LE}$ is the Leading Edge Radius (e.g., 0.012 in.). A smaller value for the Aerodynamic Lead-In Factor results in a shorter upstream lead-in section before turning starts, whereas a larger value results in a longer upstream lead-in section with a shorter downstream turning section.

Those skilled in the art will readily appreciate that the greater the Aerodynamic Loading Factor LF the greater the amount of turning that will occur toward the lead-in section of the vane. Conversely, the lesser the Loading Factor LF the greater will be the amount of turning that occurs at the trailing edge of the vane. The risk associated with defining a higher Loading Factor is that the air flow can separate from the suction surface of the vane. The risk associated with defining a lower Loading Factor is that there can be inconsistent turning of the air flow through the swirler with the exit air greatly deviating from the exit vane angle. A proper balance must therefore be achieved to ensure that the airflow remains attached to the vane walls throughout the extent of the swirl passage 48.

As mentioned above, each turning vane 50 has an aerodynamic or airfoil shape. Thus, the width or thickness of each turning vane 50 varies along its axis. In one embodiment of the subject invention, the thickness and pitch varies continuously along the axial extent of the downstream vane section 58. In this regard, the thickness of a vane 50 at any given axial position x is expressed as the Instantaneous Normal Vane Thickness $t_x$ which is defined by the following equation:

$$t_x=t_{max}-(t_{max}-t_{TE})(\Delta)^{TF}$$

where: $t_{max}$ is the Maximum Normal Vane Thickness (e.g., 0.08 in.); $t_{TE}$ is the Trailing Edge Vane Thickness (e.g., 0.025 in.); and TF is the Thickness Factor, which is a dimensionless quantity (e.g., 1.6) that controls the distribution of the change in the thickness of the turning vane in the transition from the leading edge of the vane to the trailing edge of the vane.

The Maximum Normal Vane Thickness $t_{max}$ arises in the transitional vane section 60 between the upstream vane section 56 and the downstream vane section 58. The Trailing Edge Vane Thickness $t_{TE}$ is the thickness or width of the vane at the trailing edge 54. It is envisioned that the trailing edge 54 of each vane 50 can be formed with or without a radius. Furthermore, the trailing edge vane thickness $t_{TE}$ can be minimized to an acceptable balance between manufacturability and a tendency to shed downstream vortices, which can negatively impact the atomization process.

As described above, Thickness Factor TF controls the change in the thickness of each vane 50. Accordingly, a greater Thickness Factor will delay the thickness change along the axial extent of the downstream vane section 58 to the trailing edge 54. In contrast, a lesser Thickness Factor will rapidly change the width of the vane from a maximum thickness to a minimum thickness closer to the transitional vane section 60.

As described above, in one embodiment of the subject invention, the pitch of the downstream vane section 58 differs from the pitch of the upstream vane section 56 and is held constant along substantially the entire axial extent of the downstream vane section 58. In another embodiment of the subject invention, two or more contiguous axial vane segments of the downstream vane section 58 have different but constant pitches, such that the downstream vane section 58 has multiple joined leads along the axial extent thereof.

In such cases, the Instantaneous Vane Angle over a certain axial vane segment extending from an initial axial location to a final axial location is defined by the equation:

$$\beta^*_x=\beta^*_f-(\beta^*_f-\beta^*_i)(1-\Delta_l)^{LF}$$

where: $\Delta_l$ is the Vane Length Ratio for that axial vane segment and is defined by the following equation:

$$\Delta_i = \frac{l_f - l_x}{l_f - l_i}$$

Furthermore, the Instantaneous Normal Vane Thickness $t_x$ over a certain axial vane segment extending from an initial axial location to a final axial location is defined by the following equation:

$$t_x=t_i-(t_i-t_f)(\Delta_t)^{TF}$$

where: $\Delta_t$ is the Vane Thickness Ratio for that axial vane segment and is defined by the following equation:

$$\Delta_i = \frac{l_f - l_x}{l_f - l_i}.$$

In view of each of the preceding equations, those skilled in the art will readily appreciate that the unique aerodynamic vane geometry described herein is highly variable. That is, for any given axial vane segment along the length of the turning vane, vane thickness could vary while pitch remains constant, vane thickness could remain constant while pitch varies, or both vane thickness and pitch could vary.

It is envisioned and well within the scope of the subject disclosure that the airfoil geometry of the helical turning vanes 50 of air swirler 40 can be defined using the National Advisory Committee for Aeronautics (NACA) 4-digit definitions, 5-digit definitions, or the modified 4-/5-digit definitions. In each case, the airfoil shape is generated using analytical equations that describe the camber (curvature) of the mean line (geometric centerline) of the air foil section, as well as the thickness or width distribution along the length of the airfoil. Once the coordinates of the airfoil are defined, they would be converted to helical definitions to form the turning section of the vane. In this regard, a diameter would be selected and the lead would then be found at that diameter. The thickness would then be added to either side of the camber line, and the resulting values would be projected to the major and minor diameters of the vane.

Those skilled in the art will readily appreciate that over the height of each vane in the air swirler of the subject invention, the chordal axis of the vane and the turning angle associated therewith continuously changes. Furthermore, as a result of the novel vane geometry described herein, the angular velocity profile of the air flow through the swirler increases over the height of the vanes for enhanced atomization. Thus, the air velocity at the exit of the swirler is not uniform.

While the subject invention has been shown and described with reference to preferred embodiments, those skilled in the art will readily appreciate that various changes and/or modifications may be made thereto without departing from the spirit and/or scope of the subject disclosure.

For example, while the air swirler of the subject invention has been shown and described with respect to a particular fuel nozzle design, those skilled in the art will readily appreciated that the novel air swirler of the subject invention can be employed with a variety of different types of atomizing fuel nozzles. These could include airblast fuel nozzles, dual or multiple air blast nozzles, air-assisted fuel nozzles, simplex or single orifice fuel nozzles, duplex or double orifice fuel nozzles, or piloted airblast fuel nozzles where the air swirler could be used for main fuel atomization, pilot fuel atomization or both. It is also envisioned that the aerodynamically shaped helical turning vanes disclosed herein could be used to efficiently turn fluid or gas passing through a fuel swirler or injector.

What is claimed is:

1. An air swirler for a fuel nozzle comprising:

a) a central hub defining a longitudinal axis;

b) a plurality of circumferentially spaced apart axially extending helically pitched swirl vanes extending radially outwardly from the hub, each of the swirl vanes having multiple joined helical leads and a variable thickness along the axial extent thereof.

2. An air swirler as recited in claim 1, wherein each of the swirl vanes includes an upstream vane section having a leading edge surface and a downstream vane section having a trailing edge surface.

3. An air swirler as recited in claim 2, wherein the leading edge surface of the upstream vane section of each of the swirl vanes is disposed at an angle relative to the longitudinal axis of the central hub, defining an initial pitch along the axial extent of the upstream vane section.

4. An air swirler as recited in claim 2, wherein the downstream vane section has a continuously varying pitch along the axial extent thereof.

5. A fuel nozzle as recited in claim 2, wherein the downstream vane section has a constant pitch along an axial extent thereof.

6. An air swirler as recited in claim 2, wherein each of the swirl vanes includes a transitional vane section that blends the upstream vane section into the downstream vane section.

7. An air swirler as recited in claim 6, wherein each of the swirl vanes has a maximum normal thickness associated with the transitional vane section.

8. An air swirler as recited in claim 7, wherein the normal thickness varies from the transitional vane section to the trailing edge surface of each of the swirl vanes.

9. An air swirler as recited in claim 7, wherein the normal thickness remains constant for at a least an axial segment from the transitional vane section to the trailing edge surface of each of the swirl vanes.

10. An air swirler as recited in claim 7, wherein the normal thickness varies from the transitional vane section to the leading edge surface of each of the swirl vanes.

* * * * *